United States Patent [19]

Hahn

[11] 4,232,915

[45] Nov. 11, 1980

[54] CONSOLE FOR HOLDING NAUTICAL INDICATORS

[75] Inventor: Joachim Hahn, Oberursel, Fed. Rep. of Germany

[73] Assignee: VDO Adolf Schindling AG, Frankfurt am Main, Fed. Rep. of Germany

[21] Appl. No.: 902,702

[22] Filed: May 4, 1978

[30] Foreign Application Priority Data

May 9, 1977 [DE] Fed. Rep. of Germany ..... 2720764

[51] Int. Cl.[2] ..... A47B 87/00; H01H 9/02

[52] U.S. Cl. ..... 312/107; 312/111; 174/53; 220/23.4

[58] Field of Search ..... 312/111, 107, 108, 229, 312/9, 198; 220/23.4, 66; 85/53, 55; 174/53

[56] References Cited

U.S. PATENT DOCUMENTS

| | | | |
|---|---|---|---|
| 2,482,174 | 9/1949 | Hake | 312/111 |
| 2,912,294 | 11/1959 | Wells et al. | 312/111 |
| 3,159,436 | 12/1964 | Davis | 312/107 |
| 3,187,084 | 6/1965 | Stillman et al. | 174/53 |
| 3,279,014 | 10/1966 | Fischer | 312/107 |
| 3,298,272 | 1/1967 | Henderson | 85/53 |
| 3,450,427 | 6/1969 | Fischer | 85/53 |
| 3,517,977 | 6/1970 | Wenger | 312/111 |
| 3,563,624 | 2/1971 | Stice | 312/111 |
| 3,763,400 | 10/1973 | Layton et al. | 312/108 |
| 3,770,872 | 11/1973 | Brown | 174/53 |
| 3,770,873 | 11/1973 | Brown | 174/53 |
| 3,834,781 | 9/1974 | Logsdon | 312/229 |

FOREIGN PATENT DOCUMENTS

| | | | |
|---|---|---|---|
| 2041540 | 8/1970 | Fed. Rep. of Germany | 312/111 |

*Primary Examiner*—Victor N. Sakran
*Attorney, Agent, or Firm*—Otto John Munz

[57] ABSTRACT

A console for holding nautical indicators has a back wall, opposite, generally parallel side walls, top and bottom walls and an open front for receiving an indicator. Preformed openings are in the side walls, closed by a frangible membrane, for receiving fasteners through aligned openings in adjacent side walls of two consoles placed side-by-side to secure the two consoles together as a unit. Each console is configured to support and enclose a single indicator, and a plurality of consoles with associated indicators may be readily secured together to form a multi-indicator console.

9 Claims, 4 Drawing Figures

CONSOLE FOR HOLDING NAUTICAL INDICATORS

BACKGROUND OF THE INVENTION

The invention relates to a console for holding nautical indicators, which console has a rectangular open front side for holding at least one indicator with a rectangular front frame, and is closed by four side walls and a backwall.

PRIOR ART

Prior art consoles for holding nautical instruments are constructed in such a way that they can hold several nautical indicators, such as a log for measuring the nautical mileage covered by a watercraft, an indicator for the speed of the watercraft, an indicator for the wind direction, an indicator for the wind velocity, etc. Frequently, not all indicators needed in the course of time are installed in the console from the very beginning. On the contrary, it happens often that the owner of a watercraft starts with a minimum of indicators but as time goes on, considers an addition of further indicators desirable. The known consoles can serve for holding a variable number of indicators only insofar as they are originally dimensioned for a maximum number of indicators, e.g., four, in which case the empty spaces are at first capped by a blank cover.

This prior art extended holding device or console, only partially filled by instruments, however, is not fully satisfactory in esthetic respect. Moreover, the possibility of installing a variable number of indicators in such a console is limited to the number envisaged in the manufacture of the console. To be sure, it is conceivable to provide a number of consoles, each having a width or size for the number and type of indicators to be combined therein, but this would involve unreasonable manufacturing and storage requirements, so that the individual consoles would be relatively expensive.

SUMMARY OF THE INVENTION

The present invention is based on the purpose of producing—while eliminating the aforementioned defects—a console of the initially mentioned type which is offhand adaptable to the needs of each case, or the number of instruments desired, and can therefore be employed in a great variety of instances. The manufacturing and storage requirements of this console are simple and inexpensive. Finally, the console has good appearance, and blank covers are eliminated.

This purpose is achieved by a console in which a single console is dimensioned for holding only a single indicator which covers with its front frame the entire open front side of the console, and wherein the indicator is fastened to the back wall of the single console. Moreover, in each of at least two parallel side walls of a single console, at least two holes are prepared in corresponding positions, with frangible membranes covering the holes, so that, after the piercing of the membranes to form open holes, a second single console adjacent to the sidewall of the first console can be secured thereto by extending fasteners through the holes so as to form a combination console consisting of a number of secured together single consoles.

Therefore, in the structure a separate single console is provided for holding each individual indicator. The single console may—when on the whole only one indicator is present—constitute the complete console. Normally however, when the console is to be dimensioned for holding several indicators, it is possible for the customer to secure together a number of single consoles which corresponds to the number of instruments desired, so as to form a combination console. The securing together of the consoles can be carried out in a simple manner and without requiring any special tool by inserting, for example, cheese-head screws through the prepared holes in the side walls of the individual consoles, which are positioned close to each other, and by screwing nuts upon the ends of the cheese-head screws that protrude from the side walls. In this process the side walls are pressed into a solid unit by the screw connection. The individual consoles abut tightly against each other in this structure and form a solid unit, namely, the combination console. This construction is particularly advantageous for the reason that for any number of indicators to be held by the combination console only a single type of a single console must be manufactured and kept in storage. The combination console can therefore at any time be adapted offhand to the actual requirements by the customer at a relatively low expense, e.g., when the number of indicators to be held is to be increased. Blank covers of a combination console that is originally too large, which covers might impair the appearance, are thus eliminated. Since the holes prepared in the individual consoles are closed at first and may suitably be opened to the actual necessary extent only, the inside of the combination console with inserted indicators is hermetically sealed toward the outside. In this structure, the secured together side walls of the individual consoles form bulkheads or partitions between instruments.

OBJECTS OF THE INVENTION

Advantageously, the console is constructed in such a way that the open front side of the individual console is defined or surrounded by a recessed shoulder in the side walls, on which shoulder the front frame of the indicator comes to rest. This permits a particularly stable installation of the indicator since the front frame of the indicator is also supported by the portion of the side walls that protrudes from the shoulder. This creates an esthetically very satisfactory impression, especially when the depth of the front frame corresponds to the depth of the recessed shoulder, so that the front frame and the front side of the side walls terminate smoothly on the front side of the console.

For the customary indicators, the console, according to the aforementioned characteristics, is constructed in such a way that the front side of the individual console as well as the front frame of the indicators to be inserted is square. Thus the space and material requirements for an individual console may be kept small while the esthetic appearance remains good.

Another advantage of the invention is that the individual console presents the characteristic that in each side wall four holes are provided. This makes possible a particularly stable connection with the adjacent individual console.

In a suitable manner, the console is furthermore constructed with the characteristic that in at least two parallel side walls of the individual console an additional opening for the insertion of a laced wiring harness is prepared. This additional opening is normally closed just as the openings for inserting the screw connection, and can be pierced when necessary. This additional opening permits the wiring of the indicators without impairing the holding and shutting-off or sealing effect of the side walls.

A particular advantage is that the individual console consists of plastic material and in that the prepared holes in the side walls are covered with a sprayed-on skin which defines a flat, planar surface on the side walls. This structure complies particularly with the requirements for an inexpensive manufacture and a good appearance of the individual consoles and the combination console composed thereof. The sprayed-on skin, before being removed when necessary, forms a uniform surface with the other surface areas of the side walls. Therefore no moisture and no water can enter the individual consoles as long as a sprayed-on skin is not removed. Nor do the individual consoles reveal any holes on the outsides of the combination console, so that the esthetic impression is not impaired. Only the sprayed-on skin of the actually needed holes is removed—by means of a tool if necessary—so as to form the necessary perforations for screwing the individual consoles together and inserting the cables. A plastic known under the protected tradename "Hostaform" of the Hoechst A. G. is suitably used as plastic material.

A further advantage of the console is that the back wall of the individual console is provided with at least one opening in a recess through which a threaded bolt of the indicator can be inserted, and that a nut screwed upon the threaded bolt can be covered in the recess by a closure cover. In this structure of the console, the indicator is slid from the front into the open front side and fastened by the screwing-in of the threaded bolt which extends through the back wall. By means of the closure cover which covers the nut in the recess, the combination cosole is given a compact appearance from the back side.

The console of the invention permits the indicator with its front frame, but without a casing, to be inserted in the individual console, and the individual console takes over the function of the casing normally necessary for an indicator, namely, the sealing-off of the measuring mechanisms from the surroundings. Thus the total expense for the console and the indicators installed therein can be further reduced.

The invention will be explained in greater detail with the aid of the drawing which contains the preferred embodiment.

DETAILED DESCRIPTION OF THE PREFERRED EMBODIMENT

Figure 1:
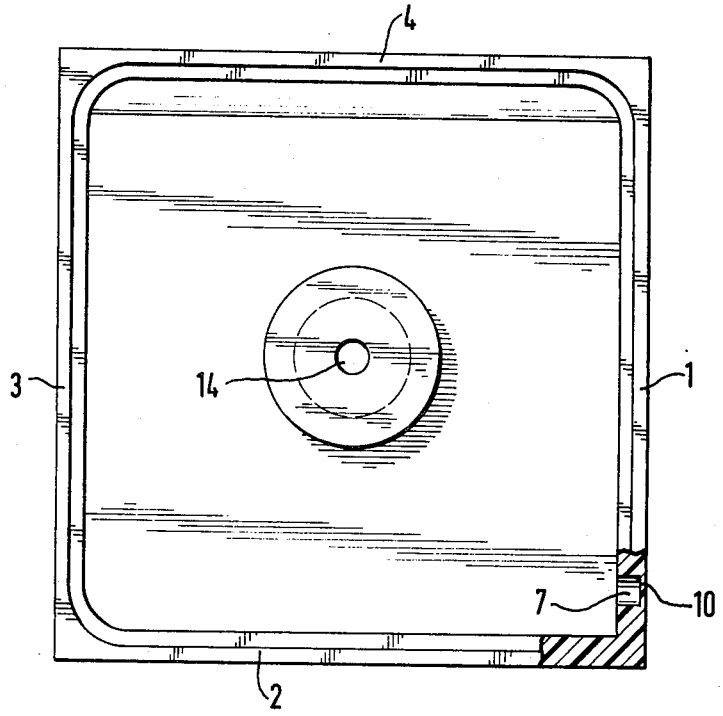
FIG. 1 is a front plan view of an empty single console.

The console is shown on a reduced scale in the drawings, and in all figures, corresponding elements are indicated by the same reference symbols.

Figure 2:
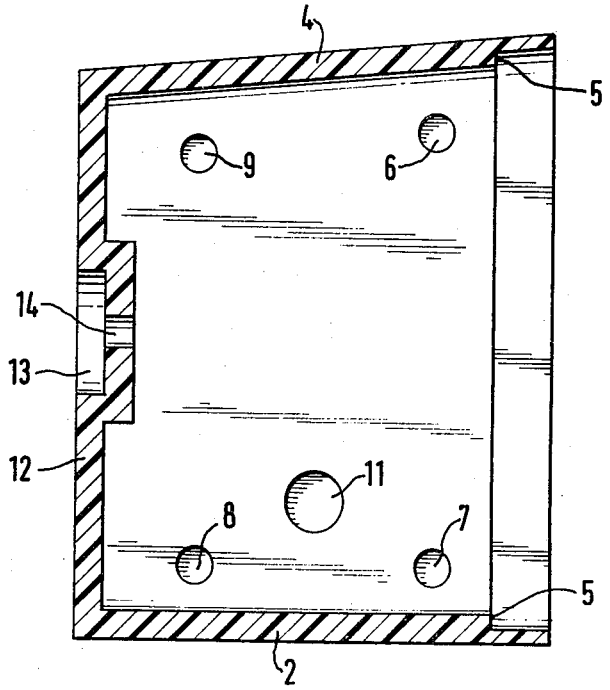
FIG. 2 is a cross section through the single console of FIG. 1.

FIGS. 1 and 2 show an empty single console which is essentially shaped like a square building stone and has a square front side. The open front side is limited by four side walls 1, 2, 3 and 4, two of which, namely side walls 1 and 3, are parallel. While the lower side wall 2 extends horizontally, the upper side wall 3 is shown as inclined by an angle of 5° with respect to the horizontal. In detail, the limitation of the open front side consists in a recessed shoulder 5 on which the thickness of the side wall is graded.

Furthermore, from FIG. 2, the position of prepared holes 6, 7, 8 and 9 in side wall 1 is recognizable, which holes correspond to the holes (not shown) in the same position in side wall 3. As a broken-off portion in FIG. 1 shows, the prepared holes are covered toward the outside by a sprayed-on skin 10. The sprayed-on skin of the plastic casing has, in the preferred embodiment, a thickness of 0.3 mm. An additional opening 11, which is likewise covered by a sprayed-on skin serves for passing the wiring through the side wall.

The empty single console is closed in the rear by a back wall 12. The backwall has a recess 13 provided with a passage hole 14.

Figure 3:
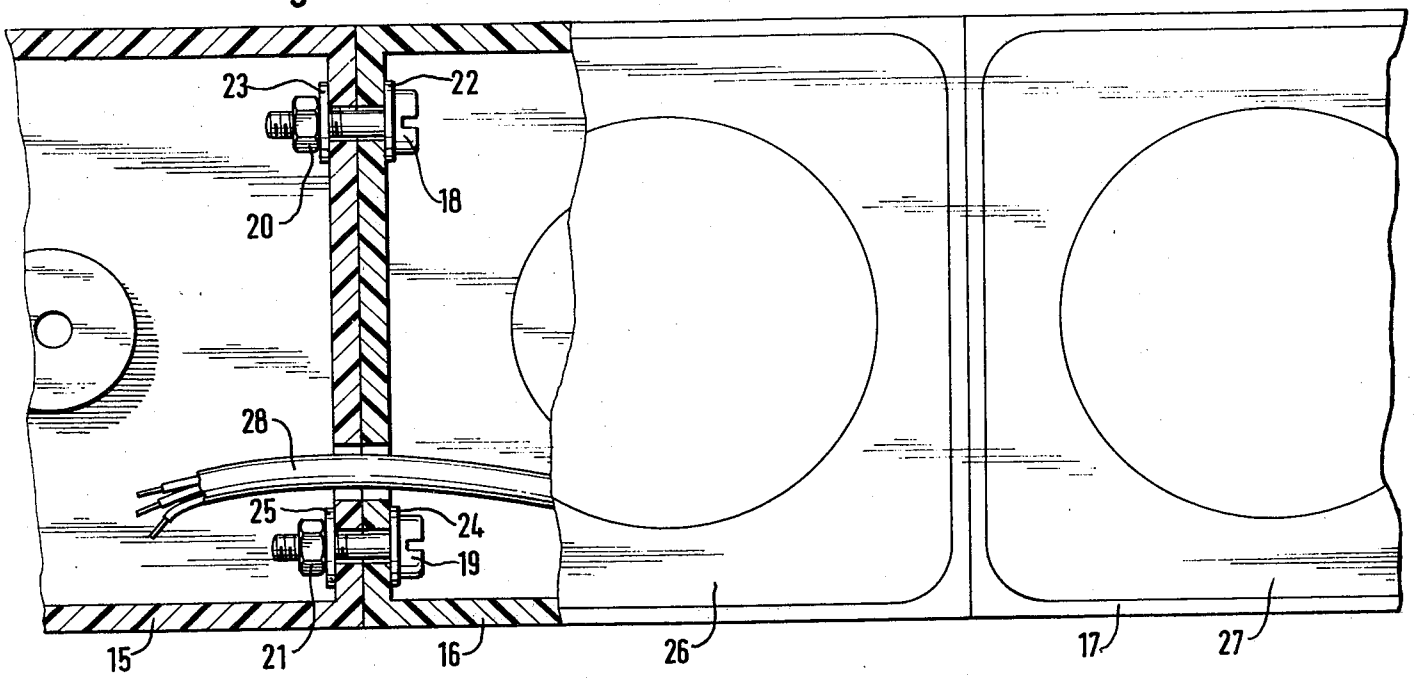
FIG. 3 is a front plan view, with portions in section of a combination console, composed of single consoles, secured together.

In FIG. 3, three single consoles 15, 16, 17 are firmly connected so as to form a combination console. For this purpose, cheese-head screws 18 and 19 extend through the holes 6,7,8 and 9, in the side walls of the adjacent single consoles to secure them together as seen at 15 and 16 in FIG. 3. The screw connection is established by nuts 20 and 21 screwed upon the cheese-head screws, in which structure washers 22, 23,24 and 25 are provided at each pressure point of the screw connection.

Figure 4:
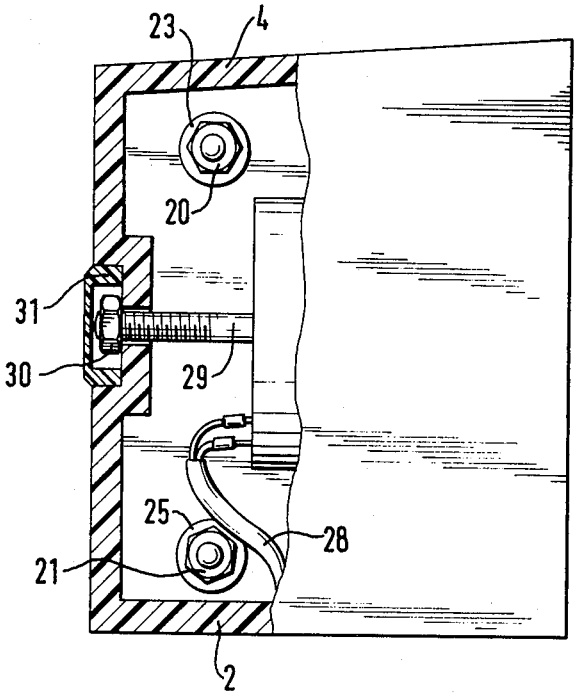
FIG. 4 is a side plan view, partially in section, of a single console and indicator.

In the combination console thus formed, the indicators with front frames 26, 27, as shown in FIG. 3, can be inserted. Before the indicators are fastened, the wiring with the laced wiring harness 28 is connected to the still pulled-out indicators. Then a threaded bolt 29 protruding from the back side of the indicator is inserted through the passage hole 14 in recess 13, as shown in detail in FIG. 4, and a nut 30 is screwed on to the bolt 29 to secure the indicator to the back wall 12. The screw connection is finally covered by a lid 31.

The complete combination console can usually be mounted, by means not shown in the drawing, on a support of a watercraft and can be connected to the primary elements for the indicators.

It is possible to expand the combination console at any time by further single consoles, for which purpose the prepared holes covered with the sprayed-on skins in the side walls of the outer single consoles must be pierced so as to serve for holding further screw connections.

I claim:

1. A console for holding nautical indicators, comprising:

a one-piece molded plastic housing having integral side walls, a back wall, a bottom wall, a top wall and an open front for receiving and holding an indicator, said console being dimensioned to hold only a single indicator with a front frame thereof covering the open front of the console;

said side walls including a pair of spaced apart, generally parallel side walls each having an opening therein in like positions in the respective walls; and said openings being covered by a frangible membrane comprising a thin spayed-on-skin, whereby a plurality of said consoles may be placed side-by-side, with the membranes covering the openings in adjacent side walls of adjacent consoles pierced for receiving fasteners through the respective openings to secure the single consoles together to form a combination console.

2. A console as claimed in claim 1, wherein the open front of the single console is surrounded by a recessed shoulder in the side walls on which shoulder the front frame of an indicator is adapted to rest.

3. A console as in claim 1, wherein the front of the single console and the front frame of the indicator to be inserted are square.

4. A console as in claim 1, wherein four holes are provided in each of said generally parallel side walls.

5. A console as claimed in claim 4, wherein an additional opening for inserting a laced wiring harness is provided in said generally parallel side walls.

6. A console as claimed in claim 1, wherein a plurality of single consoles are secured together to form a combination console.

7. A console as claimed in claim 1, wherein the single console comprises the casing for the indicator inserted therein, said console being closed against the environment to protect the indicator.

8. A console for holding nautical indicators, comprising:

a back wall, side walls, and an open front for receiving and holding an indicator, said console being dimensioned to hold only a single indicator with a front frame thereof covering the open front of the console;

said side walls including a pair of spaced apart, generally parallel side walls each having an opening therein in like positions in the respective walls;

said openings being covered by a frangible membrane, whereby a plurality of said consoles may be placed side-by-side, with the membranes covering the openings in adjacent side walls of adjacent consoles pierced for receiving fasteners through the respective openings to secure the single consoles together to form a combination console; and the back wall of the single console being provided with at least one opening in a recess, through which a threaded bolt of the indicator can be passed, and a nut screwed upon the threaded bolt within the recess, and a closure cover for closing the recess and covering the nut.

9. A console for holding nautical indicators comprising:

a one-piece molded plastic housing having integral side walls, a back wall, a bottom wall, a top wall, and an open front for receiving and holding an indicator, said console being dimensioned to hold only a single indicator with a front frame thereof covering the open front of the console;

said side walls including a pair of spaced apart, generally parallel side walls each having an opening therein in like positions in the respective walls; and said openings being covered by a frangible membrane integral with the side wall whereby a plurality of said consoles may be placed side-by-side, with the membranes covering the openings in adjacent side walls of adjacent consoles pierced for receiving fasteners through the respective openings to secure the single consoles together to form a combination console, the back wall of the single console provided with at least one opening in a recess, through which a threaded bolt of the indicator can be passed, and a nut screwed upon the threaded bolt within the recess, and a closure cover for closing the recess and covering the nut.

* * * * *